United States Patent [19]

Gault et al.

[11] 4,136,045

[45] Jan. 23, 1979

[54] DETERGENT COMPOSITIONS CONTAINING ETHOXYLATED NONIONIC SURFACTANTS AND SILICONE CONTAINING SUDS SUPPRESSING AGENTS

[75] Inventors: Terrell W. Gault, Seattle, Wash.; Edward J. Maguire, Jr., Cincinnati, Ohio

[73] Assignee: The Procter & Gamble Company, Cincinnati, Ohio

[21] Appl. No.: 841,078

[22] Filed: Oct. 11, 1977

Related U.S. Application Data

[63] Continuation-in-part of Ser. No. 731,257, Oct. 12, 1976, abandoned, which is a continuation-in-part of Ser. No. 622,303, Oct. 14, 1975, abandoned, and Ser. No. 622,304, Oct. 14, 1975, abandoned.

[51] Int. Cl.[2] ..... C11D 3/20; C11D 1/66

[52] U.S. Cl. ..... 252/135; 252/89 R; 252/DIG. 1

[58] Field of Search ..... 252/89, 135, 321, 358, 252/DIG. 1, DIG. 14

[56] References Cited

U.S. PATENT DOCUMENTS

| | | | |
|---|---|---|---|
| 3,314,891 | 4/1967 | Schmolka et al. | 252/89 R |
| 3,329,625 | 7/1967 | Hoxie | 252/358 |
| 3,336,231 | 8/1967 | Marsh et al. | 252/321 X |
| 3,784,479 | 1/1974 | Keil | 252/358 |
| 3,829,386 | 8/1974 | Wegst et al. | 252/135 |
| 3,888,781 | 6/1975 | Kingry et al. | 252/135 X |
| 3,933,672 | 1/1976 | Bartolotta et al. | 252/89 R X |
| 3,962,119 | 6/1976 | Cosentino et al. | 252/89 R |
| 4,005,044 | 1/1977 | Raleigh | 252/321 X |

FOREIGN PATENT DOCUMENTS

| | | |
|---|---|---|
| 525433 | 5/1956 | Canada. |
| 1340043 | 12/1973 | United Kingdom. |

*Primary Examiner*—Harris A. Pitlick

*Attorney, Agent, or Firm*—Robert B. Aylor; Thomas H. O'Flaherty; Richard C. Witte

[57] ABSTRACT

Detergent compositions, including compositions for use in automatic dishwashing machines, are prepared by incorporating into the composition an intimate mixture of a nonionic surfactant and a silicone-containing suds suppressing agent. The compositions have reduced or controlled sudsing characteristics even after extended storage periods. The use of preferred self-emulsified silicone suds suppressors permits the production of low-sudsing spray-dried detergent granules without necessitating separate incorporation of the suds suppressors.

38 Claims, No Drawings

DETERGENT COMPOSITIONS CONTAINING ETHOXYLATED NONIONIC SURFACTANTS AND SILICONE CONTAINING SUDS SUPPRESSING AGENTS

CROSS REFERENCE TO RELATED APPLICATIONS

This application is a continuation-in-part of co-pending application Ser. No. 731,257 for DETERGENT COMPOSITIONS, filed Oct. 12, 1976, now abandoned, which is, in turn, a continuation-in-part of Ser. No. 622,303, filed Oct. 14, 1975, now abandoned, and Ser. No. 622,304, filed Oct. 14, 1975, now abandoned.

BACKGROUND OF THE INVENTION

This invention relates to detergent compositions and, in particular, to detergent compositions which have controlled sudsing characteristics, especially those useful in automatic dishwashing.

Detergent compositions normally contain surfactants which tend to produce foam when agitated in aqueous solution. For many applications, especially in automatic washing and dishwashing machines, excess foam production is a serious problem with detergent compositions and with many effective surfactants it is necessary to add foam inhibiting compounds, hereinafter called suds suppressors, in order to achieve acceptable sudsing characteristics.

Unfortunately, it has been found that the addition of suds suppressors can in itself create new problems. For example, monostearyl acid phosphate, which is one conventional suds suppressor, is very effective and useful at low levels in the product, but as the level of suds suppressor is increased to cope, for example, with increased surfactant, then the suds suppressor becomes incompletely soluble in a wash solution and precipitates out of solution onto utensil and machine surfaces leaving them coated with unsightly streaks and deposits.

Another type of suds suppressor which has often been suggested is that based on silicones, especially polydimethylsiloxane. These materials, referred to generically hereinafter as silicone suds suppressors, are known to be very useful in industrial applications where the silicone suds suppressor is added directly to an aqueous solution containing a surfactant. However, they have not lived up to their promise when incorporated into detergent compositions; frequently, for example, they become inactivated in the presence of other detergent ingredients and require some type of special protection.

It has now been found that stable suds suppressed detergent compositions can be prepared by incorporating silicone materials into the compositions in a particular manner.

Accordingly, it is an object of the invention to provide detergent compositions which are storage-stable and which include silicone suds suppressors.

It is a further object of the invention to provide a process for the incorporation of silicone suds suppressors into detergent compositions to provide storage-stable suds-suppressed compositions.

Another problem exhibited by conventional silicone suds suppressors, such as polydimethylsiloxane, is that they are either completely inactivated in the spray-drying process or they lose their activity very quickly after the spray-dried granules have been made.

In the preparation of spray-dried detergent granules an aqueous mixture of the various components of the granules (the crutcher mix) is sprayed or otherwise introduced into what is essentially a drying tower. As the droplets of the crutcher mix proceed through the drying tower, the water is flashed off and solid or semi-porous detergent granules are secured. The advantage of spray-dried detergent granules over granules obtained by simple dry mixing of the individual ingredients is their homogeneity. That is to say, each granule contains the various ingredients in the same ratio proportions introduced into the original crutcher mix. This provides obvious advantages over simple dry mix detergent formulations, inasmuch as dry mixing can result in a lack of homogeneity in the final detergent formulations such that the user is never certain of the composition of any given portion of the product.

In order to provide a homogeneous spray-dried granule it is necessary that the crutcher mix, itself, be substantially homogeneous. In some instances, a crutcher mix may be a homogeneous solution. However, in order to provide a crutcher solution, excess amounts of water are needed to dissolve all the components. Use of excessive amounts of water requires additional drying capacity in the spray-dry tower and is not economically attractive. For the most part, the crutcher mixes employed in the preparation of spray-dried detergent compositions are semidissolved aqueous slurries of the various components desired in the final spray-dried granules.

The crutching and spray-drying process, while possessing the above advantages, does create a problem with regard to the incorporation into the granules of relatively sensitive ingredients, such as the conventional silicone suds suppressors, at least partly as a result of the high alkalinity and temperatures present during the crutching stage. Such ingredients can of course be incorporated into the composition after spray-drying, for example, by dry mixing or spraying on. But the necessity of such an extra step in the process is undesirable. In addition, certain ingredients, especially those present in minor amounts, are not easy to distribute uniformly throughout a spray-dried granular composition. Clearly then, a very desirable way to include a silicone suds suppressor into a detergent composition would be simply to add the material directly to the crutcher mix before spray-drying.

Furthermore, it is known that the introduction of alkoxylated nonionic surfactants into an aqueous detergent crutcher mix tends to cause inhomogeneity in the mix. This is because the nonionic materials tend to be oily and to exist in a separate phase. This problem can be helped by the use of agents such as certain alkyl phosphate esters or preferably, as is taught in the copending U.S. patent application Ser. No. 589,116, by R. M. Wise, filed June 23, 1975, by using kaolinite or bentonite clays. However, this problem of inhomogeneity in the crutcher mix is exacerbated by the addition of conventional silicone suds suppressors, such as polydimethysiloxane, since these materials are themselves oily and do not disperse well either in water or in nonionic surfactant.

It is therefore an additonal object of this invention to provide spray-dried detergent granules which include a nonionic surfactant and also a silicone suds suppressor.

It is a further object herein to provide an improved process for the incorporation of certain silicone suds suppressors into spray-dried detergent granules containing substantial quantities of nonionic surfactant.

DESCRIPTION OF THE PRIOR ART

Silicones are widely known as useful suds suppressing agents in aqueous systems. For example, U.S. Pat. Nos. 3,250,727; 3,383,327; and 3,455,839 relate to suds suppressors based on polydimethyl-siloxane and their use in defoaming aqueous solutions.

U.S. Pat. No. 3,235,509 relates to silicone suds suppressors which are absorbed into a solid silica material in order to improve their stability towards alkaline materials. However, even this silicone/silica material has been found unsatisfactory for certain applications and U.S. Pat. No. 3,933,672, Bartolotta et al, issued Jan. 20, 1976, relates to the further protection of silicone/silica materials by their incorporation into a solid, substantially non-surface active matrix.

Clearly, the additional step of encapsulating or otherwise protecting the silicone material in an inert carrier is both expensive and time-consuming, and it has therefore been suggested in Canadian Pat. No. 525,433 and in U.S. Pat. No. 3,829,386 that a silicone suds suppressor can be incorporated into a base product (for example, a carrier granule which may be alkaline) using a normally liquid surfactant as an incorporation medium. Unfortunately, this approach has not been found to be entirely satisfactory since most conventional silicone materials, for example polydimethylsiloxane itself, do not disperse well in liquid surfactants and tend to migrate out of the surfactant into contact with other more harmful constituents of the compositions.

It has further been suggested, in French Pat. No. 2,279,843, that certain silicone suds suppressor materials may be formed into a powder and then mixed together with detergent granules. As above, this procedure introduces additional steps into the detergent-making process.

SUMMARY OF THE INVENTION

According to the present invention there is provided a detergent composition comprising an intimate mixture of from about 2.5% to about 100% by weight of the composition of a nonionic surfactant and a suds suppressing amount of a silicone suds suppressor, said intimate mixture being selected from the group consisting of (a) a mixture of a normally solid nonionic surfactant with a non-self-emulsified silicone suds suppressor and (b) a mixture of a normally liquid or solid nonionic surfactant with a self-emulsified silicone suds suppressor. Self-emulsified suds suppressors are characterized by the presence of an emulsifying component, are highly dispersible in solid nonionic surfactants and will self-emulsify in liquid nonionic surfactants.

The silicone suds suppressor of the instant compositions is employed herein in a "suds suppressing amount." By "suds suppressing amount" is meant that the formulator of the compositions can select an amount of the suppressor which will control the suds to the extent desired. For example, for use in automatic dishwashers, a suds height of zero or near-zero is desirable; accordingly relatively more of the suds suppressor will be used. For hand dishwashing, relatively less suds suppressors will be used. For laundry washing machines, the amount of suds which can be tolerated may vary widely depending on the particular application, and accordingly more or less of the suds suppressors will be used. The amount of suds controller will also vary with the detergent component selected. For example, with high sudsing surfactants, relatively more of the controller is used to achieve the desired suds control than when low foaming detergents are selected for use in the compositions herein.

The term "nonionic surfactant" is not intended to include compounds which, although they have certain surface active properties, provide substantially no detergent ability. Typical of such materials not encompassed by the invention are the polyethyleneglycols and condensates of more than about 20 moles of ethylene oxide with a long-chain alcohol.

Particularly, the mixture of normally solid nonionic surfactant and non-self-emulsified silicone suds suppressor may comprise the following composition:

(A) from about 10% to about 60% by weight of a detergent builder salt, and (B) an intimate mixture consisting essentially of (i) from about 0.5% to about 50% by weight of the composition of a normally solid nonionic surfactant, and (ii) from about 0.01% to about 10% by weight of the composition of a non-self-emulsified silicone suds suppressor.

In preferred compositions, the nonionic surfactant is selected from the group consisting of (a) the condensation product of alkyl phenols with from about 5 to 20 moles of ethylene oxide;

(b) the condensation product of $C_8$–$C_{22}$ aliphatic alcohols with from about 3 to 18 moles of ethylene oxide;

(c) the condensation product of ethylene oxide with a hydrophobic base formed by the condensation of propylene oxide with propylene glycol, wherein the molecular weight of the hydrophobic portion is from about 1,500 to about 1,800;

(d) the condensation product of ethylene oxide with the product resulting from the reaction of propylene oxide and ethylene diamine, wherein the molecular weight of the hydrophobic portion is from about 2,500 to about 3,000 and the condensation product contains from about 40 to about 80% by weight of polyoxyethylene; and (e) mixtures thereof.

The mixture of normally liquid or solid nonionic surfactant and self-emulsified silicone suds suppressor may comprise the following composition:

(A) from about 10% to about 60% by weight of a detergent builder salt, and (B) an intimate mixture consisting essentially of (i) from about 0.5% to about 50% by weight of the composition of a nonionic surfactant, and (ii) from about 0.01% to about 10% by weight of the composition of a self-emulsified silicone suds suppressor containing a silicone suds suppressor and an emulsifier therefor.

In preferred compositions, the nonionic surfactant is selected from the group consisting of (a) the condensation product of alkyl phenols with from about 5 to 20 moles of ethylene oxide;

(b) the condensation product of $C_8$–$C_{22}$ aliphatic alcohols with from about 3 to 18 moles of ethylene oxide;

(c) the condensation product of ethylene oxide with a hydrophobic base formed by the condensation of propylene oxide with propylene glycol, wherein the molecular weight of the hydrophobic portion is from about 1,500 to about 1,800;

(d) the condensation product of ethylene oxide with the product resulting from the reaction of propylene oxide and ethylene diamine, wherein the molecular weight of the hydrophobic portion is from about 2,500 to about 3,000 and the condensation product contains from about 40 to about 88% by weight of polyoxyethylene; and (e) mixtures thereof.

In preferred compositions, the emulsifier is selected from the group consisting of (a) a modified polysiloxane having at least one polyoxyalkylene moiety in the polymer;

(b) a high ethoxylate of a fatty acid;

(c) the condensation product of from about 300 to about 2,000 moles of ethylene oxide per mole of fatty acid;

(d) zwitterionic surfactants; and (e) mixtures thereof.

Preferred self-emulsified silicone suds suppressors are those which contain a modified polysiloxane having polyoxyalkylene moieties in the polymer. When these materials are utilized, the present invention provides a process for preparing an aqueous crutcher mix containing a nonionic surfactant, comprising the addition to the crutcher mix of this specific type of silicone suds suppressor and blending the crutcher mix at a temperature of at least 150° F. (preferably 150° F. to 210° F.) until homogenous. The crutcher mix is then dried, preferably spray-dried, to provide homogenous detergent granules.

In its compositional aspect, this embodiment provides for homogenous, granular, spray-dried detergent compositions comprising (a) from about 2% to about 60% (preferably 5% to 35%) of an alkoxylated nonionic surfactant; and (b) a suds suppressing amount of a self-emulsified silicone suds suppressor containing a modified polysiloxane having at least one polyoxyalkylene moiety in the polymer.

As used herein, all percents, ratios and parts are by by weight unless otherwise specified.

DETAILED DESCRIPTION OF THE INVENTION

The compositions of the present invention comprise two essential components, a nonionic surfactant and a silicone suds suppressor, which, it is believed, are in intimate admixture. By the term "intimate admixture" is meant that the silicone suds suppressor is dispersed in and is in direct contact with the nonionic surfactant and does not tend to migrate out of the surfactant during storage of the composition.

It will be understood that the compositions can additionally comprise a wide range of other materials conventionally found in detergent compositions of various types and it will also be appreciated that the compositions may contain additional nonionic surfactant which are not mixed with the silicone suds suppressors.

Silicone Suds Suppressor

The silicone materials employed as the subs suppressors herein can be alkylated polysiloxane materials of several types, either singly or in combination with various solid materials such as silica aerogels and xerogels and hydrophobic silicas of various types. In industrial practice, the term "silicone" has become a generic term which encompasses a variety of relatively high molecular weight polymers containing siloxane units and hydrocarbyl groups of various types. In general terms, the silicone suds controllers can be described as containing siloxane moieties having the general structure

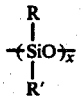

wherein $x$ is from about 20 to about 2,000, and R and R' are each alkyl or aryl groups, especially methyl, ethyl, propyl, butyl and phenyl. The polydimethylsiloxanes (R and R' are methyl) having a molecular weight within the range of from about 200 to about 200,000, and higher, are all useful as suds controlling agents. Such silicone materials are commercially available from the Dow Corning Corportion under the trade name Silicone 200 Fluids.

Additionally, other silicone materials wherein the side chain groups R and R' are alkyl, aryl, or mixed alkyl and aryl hydrocarbyl groups exhibit useful suds controlling properties. These materials are readily prepared by the hydrolysis of the appropriate alkyl, aryl or mixed alkylaryl silicone dichlorides with water in the manner well known in the art. As specific examples of such silicone suds controlling agents useful herein there can be mentioned, for example, diethyl polysiloxanes; dipropyl polysiloxanes; dibutyl polysiloxanes; methylethyl polysiloxanes; phenylmethyl polysiloxanes; and the like. The dimethyl polysiloxanes are particularly useful herein due to their low cost and ready availability.

A second type of silicone suds controlling agent useful in the compositions herein comprises a mixture of an alkylated siloxane of the type hereinabove disclosed and solid silica. Such mixtures of silicone and silica can be prepared by affixing the silicone to the surface of silica ($SiO_2$), for example by means of the catalytic reaction disclosed in U.S. Pat. No. 3,235,509. Suds controlling agents comprising mixtures of silicone and silica prepared in this manner preferably comprise silicone and silica in a silicone:silica ratio of from 19:1 to 1:2, preferably 10:1 to 1:1. The silica can be chemically and/or physically bound to the silicone in an amount which is preferably about 10% to 15% by weight, based on the silicone. The particle size of the silica employed in such silica/silicone suds controlling agents should preferably be not more than 100 millimicrons, preferably from 10 millimicrons to 20 millimicrons, and the specific surface area of the silica should exceed about 50 $m^2/g$.

Alternatively, suds controlling agents comprising silicone and silica can be prepared by admixing a silicone fluid of the type hereinabove disclosed with a hydrophobic silica having a particle size and surface area in the range disclosed above. Any of several known methods may be used for making a hydrophobic silica which can be employed herein in combination with a silicone as the suds controlling agent. For example, a fumed silica can be reacted with a trialkyl chlorosilane (i.e., "silanated") to affix hydrophobic trialkylsilane groups on the surface of the silica. In a preferred and well known process, fumed silica is contacted with trimethylchlorosilane and a preferred hydrophobic silanated silica useful in the present compositions is secured.

In an alternate procedure, a hydrophobic silica useful in the present compositions and processes is obtained by contacting silica with any of the following compounds:

metal, ammonium and substituted ammonium salts of long chain fatty acids, such as sodium stearate, aluminum stearate, and the like; silylhalides, such as ethyltrichlorosilane, butyltrichlorosilane, tricyclohexylchlorosilane, and the like; and long chain alkyl amines or ammonium salts, such as cetyl trimethyl amine, cetyl trimethyl ammonium chloride, and the like.

A preferred suds controlling agent herein comprises a hydrophobic silanated (most preferably trimethylsilanated) silica having a particle size in the range from about 10 millimicrons to 20 millimicrons and a specific surface area above about 50 $m^2/g$ intimately admixed with a dimethyl silicone fluid having a molecular weight in the range of from about 500 to about 200,000, at a weight ratio of silicone to silanated silica of from about 19:1 to about 1:2. Such suds controlling agents preferably comprise silicone and the silanated silica in a weight ratio of silicone:silanated silica of from 10:1 to 1:1. The mixed hydrophobic silanated (especially trimethylsilanated) silica-silicone suds controlling agents provide suds control over a broad range of temperatures, presumably due to the controlled release of the silicone from the surface of the silanated silica.

Yet another type of silicone suds controlling agent herein comprises a silicone fluid, a silicone resin and silica. The silicone fluids useful in such suds controlling mixtures are any of the types hereinabove disclosed, but are preferably dimethyl silicones. The silicone "resins" used in such compositions can be any alkylated silicone resins, but are usually those prepared from methylsilanes. Silicone resins are commonly described as "three-dimensional" polymers arising from the hydrolysis of alkyl trichlorosilanes, whereas the silicone fluids are "two-dimensional" polymers prepared from the hydrolysis of dichlorosilanes. The silica components of such compositions are the microporous materials such as the fumed silica aerogels and xerogels having the particle sizes and surface areas hereinabove disclosed.

The mixed silicone fluid/silicone resin/silica materials useful in the present compositions can be prepared in the manner disclosed in U.S. Pat. No. 3,455,839. These mixed materials are commercially available from the Dow Corning Corporation. According to U.S. Pat. No. 3,455,839, such materials can be described as mixtures consisting essentially of:

(a) from about 10 parts to about 100 parts by weight of a polydimethylsiloxane fluid having a viscosity in the range from 20 cs. to 1500 cs. at 25° C.;

(b) 5 to 50 parts by weight of a siloxane resin composed of $(CH_3)_3SiO_{1/2}$ units and $SiO_2$ units in which the ratio of the $(CH_3)_3SiO_{1/2}$ units to the $SiO_2$ units is within the range of from 0.6/1 to 1.2/1; and (c) 1 to 10 parts by weight of a silica aerogel.

Such mixtures can also be sorbed onto and into a water-soluble solid as disclosed above.

The above-discussed silicone suds suppressors are, in general, not readily dispersible in nonionic surfactants and if they are dispersed by agitation, they tend to settle migrate out of the surfactant. For the purposes of the present invention, therefore, these relatively non-dispersible silicone suds suppressors are used in admixture with nonionic surfactants which are normally solid, i.e. solid at room temperature. This will be discussed in greater detail hereinafter.

There is a type of silicone suds suppressor which is highly dispersible in solid surfactants and which self-emulsifies in liquid surfactants. This type of suppressor has little or no tendency to migrate out of the surfactant phase and, with this type of silicone material, the present invention encompasses the use of liquid, as well as solid, nonionic surfactants.

The above-mentioned self-emulsifiable silicone suds suppressors are characterized by the presence of an emulsifying component in the suds suppressor compositions. The preferred self-emulsified suds suppressors are those which contain emulsifiers which have at least one polyoxyalkylene moiety incorporated into a basic polysiloxane structure. The polyoxyalkylene moieties are preferably incorporated as polymer groups substituted on silicone atoms and pendant on the basic polysiloxane chain. However, provided that the silicone compound is rendered into an emulsifier, the polyoxyalkylene moieties can be in other positions and may, for example, form a part of the basic polymer chain; i.e., as a block co-polymer. The use of these preferred emulsifiers in the silicone suds suppressor composition permits the inclusion of the suds suppressors in an aqueous, alkaline crutcher mix, and the formation of a spray-dried, granular detergent composition containing the suds suppressors in active form.

Highly-preferred emulsifiers of the type described above are typically represented by the formula $$R_aSiY_{4-a}$$

wherein a is 0 or an integer from 1 to 3; R is selected from the group consisting of (a) alkyl groups containing from 1 to about 30 carbon atoms, (b) groups having the formula $$-R'-(OR')_bOR''$$

wherein R' is an alkylene group containing 1 to about 6, preferably from 2 to 4, carbon atoms, b has a value of from 1 to about 100; and R'' is a capping group which can be selected from the group consisting of hydrogen, alkyl, aryl, alkaryl, aralkyl or alkenyl groups containing up to 20 carbon atoms; acyl groups containing up to 20 carbon atoms, sulfate, sulfonate, phosphate, phosphonate, borate or isocyanate groups, or mixtures thereof; and Y is a group having the formula $$(-O-\underset{\underset{R}{|}}{\overset{\overset{R}{|}}{Si}}-)_c-OSiR_3$$

wherein R has the formula given hereinbefore, and c has a value from 1 to 200; and wherein at least one R group in the compound has the aforesaid formula $$[-R'(OR')_b-R'']$$

in which b is sufficiently large to create an emulsifier.

Preferred emulsifiers and self-emulsifiable silicone suds controlling agents containing them are those described in Morehouse, U.S. Pat. Nos. 3,233,986 and 3,511,788, said patents being incorporated herein by reference. The agents of U.S. Pat. No. 3,511,788 are most preferred. Preferred combinations of these emulsifiers together with silicone suds controlling agents are disclosed in British Pat. No. 1,373,903 and U.S. Pat. No. 3,746,653, both of said patents being incorporated herein by reference. Preferably, the mixtures will contain at least 50% of $R_aSiY_{4-a}$, from about 5% to about 45% of a polydimethylsiloxane liquid and from 0.05% to about 5% of silica. The mixture can additionally comprise a minor amount of a polydimethylsiloxane resin.

Other effective self-emulsified silicone suds suppressors are those which contain a high ethoxylate of a fatty acid as the emulsifying component. The condensation products of from about 300 to about 2,000 moles of ethylene oxide for each mole of fatty acid are particularly useful. Fatty acids are straight-chain saturated and unsaturated monocarboxylic acids, usually containing an even number of carbon atoms (from about 10 to about 20), preferably around eighteen in number. Examples of common fatty acids include palmitic acid, stearic acid and oleic acid.

The emulsifying component may also be a zwitterionic surface active agent. Zwitterionic surfactants useful herein include derivatives of aliphatic quaternary ammonium, phosphonium and sulfonium compounds, in which the aliphatic moieties can be straight or branched chain, and wherein one of the aliphatic substituents contains from about 8 to 18 carbon atoms and one contains an anionic water-solubilizing group. Preferred switterionic materials are the ethoxylated ammonium sulfonates and sulfates disclosed in U.S. Pat. No. 3,925,262, Laughlin et al., issued Dec. 9, 1975; U.S. Pat. No. 3,939,678, Laughlin et al., issued Dec. 30, 1975; and U.S. patent application Ser. No. 603,837, Laughlin et al., filed Aug. 11, 1975, now abandoned, all of which are incorporated herein by reference.

Particularly preferred ethoxylated zwitterionic surfactants are those having the formula:

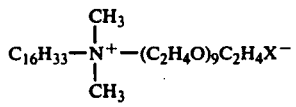

$$C_{16}H_{33}-\underset{\underset{CH_3}{|}}{\overset{\overset{CH_3}{|}}{N^+}}-(C_2H_4O)_9C_2H_4X^-$$

wherein X is $SO_3$ or $SO_4$

Additional preferred zwitterionic surfactants include those having the formula:

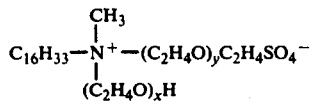

$$C_{16}H_{33}-\underset{\underset{(C_2H_4O)_xH}{|}}{\overset{\overset{CH_3}{|}}{N^+}}-(C_2H_4O)_yC_2H_4SO_4^-$$

wherein the sum of x + y is equal to about 15.

The amount of silicone suds suppressing composition used is from about 0.01% to about 10% by weight, preferably from about 0.02% to about 8% by weight, and most preferably from about 0.04% to about 6% by weight of the detergent compositions of the present invention. Other preferred amounts of silicone suds suppressing composition used are from about 0.01% to about 5%, preferably from about 0.05% to about 0.5%, and most preferably from about 0.1% to about 0.4% by weight of the detergent compositions of the present invention.

Nonionic Surfactant

As indicated above, the nonionic surfactants useful in the present invention may be solid or, when in admixture with self-emulsifiable silicone materials, liquid. The nonionic surfactant is used in the detergent compositions of the present invention in an amount from about 0.5% to about 50% by weight, preferably from about 1.0% to about 40% by weight, and most preferably from about 2.0% to about 30% by weight.

Most commonly, nonionic surfactants are compounds produced by the condensation of an alkylene oxide (hydrophilic in nature) with an organic hydrophobic compound which is usually aliphatic or alkyl aromatic in nature. The length of the hydrophilic polyoxyalkylene moiety which is condensed with any particular hydrophobic compound can be readily adjusted to yield a water-soluble compound having the desired degree of balance between hydrophilic and hydrophobic elements.

The balance between the hydrophobic and hydrophilic moieties of the nonionic surfactant and, more importantly, the chain length of each of the moieties, determines whether the surfactant is normally solid (i.e. melting point >18° C.) or normally liquid.

Examples of suitable types of nonionic surfactant (without particular reference at this point to their phase) include:

1. The polyethylene oxide condensates of alkyl phenols. These compounds include the condensation products of alkyl phenols having an alkyl group containing from about 6 to 12 carbon atoms in either a straight chain or branched chain configuration, with ethylene oxide, the said ethylene oxide being present in amounts equal to 5 to 20 moles of ethylene oxide per mole of alkyl phenol. The alkyl substituent in such compounds may be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, diisoctylphenol condensed with about 15 moles of ethylene oxide per mole of phenol. Commercially available nonionic surfactants of this type include Igepal CO-610 marketed by the GAF Corporation; and Triton X-45, X-114, X-100 and X-102, all marketed by the Rohm and Haas Company.

2. The condensation products of aliphatic alcohols with ethylene oxide. The alkyl chain of the aliphatic alcohol may either be straight or branched and generally contains from about 8 to about 22 carbon atoms. Preferably, there are from about 3 to about 18 moles of ethylene oxide per mole of alcohol. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation, Neodol 23-6.5 marketed by the Shell Chemical Company and Kyro EOB marketed by the Procter & Gamble Company.

3. The condensation products of ethylene oxide with a hydrophobic base formed by the condensation of propylene oxide with propylene glycol. The hydrophobic portion of these compounds has a molecular weight of from about 1,500 to 1,800 and of course exhibits water insolubility. The addition of polyoxyethylene moieties to this hydrophobic portion tends to increase the water-solubility of the molecule as a whole, and the liquid character of the product is retained up to the point where the polyoxyethylene content is about 50% of the total weight of the condensation product. Examples of compounds of this type include certain of the commercially available Pluronic surfactants marketed by the Wyandotte Chemicals Corporation.

4. The condensation products of ethylene oxide with the product resulting from the reaction of propylene oxide and ethylene diamine. The hydrophobic base of these products consists of the reaction product of ethylene diamine and excess propylene oxide, said base having a molecular weight of from about 2,500 to about 3,000. This base is condensed with ethylene oxide to the extent that the condensation product contains from about 40 to about 80 percent by weight of polyoxyethylene and has a molecular weight of from about 5,000 to about 11,000. Examples of this type of nonionic surfactant include certain of the commercially available Tetronic compounds marketed by the Wyandotte Chemicals Corporation.

Mixtures of the above surfactants are also useful in the present invention.

Of all the above-described types of nonionic surfactants, preferred surfactants which are normally solid include the condensation product of nonyl phenol with about 9.5 moles of ethylene oxide per mole of nonyl phenol, the condensation product of tallow fatty alcohol with about 9 moles of ethylene oxide per mole of fatty alcohol, the condensation product of a $C_{15}$–$C_{20}$ aliphatic alcohol with from about six to twenty moles of ethylene oxide, and the ethylene oxide/propylene oxide copolymer marketed under the designation of Pluronic 25R5. Preferred surfactants which are normally liquid include the condensation product of a $C_{12}$–$C_{13}$ alcohol with 3 moles of ethylene oxide per mole of alcohol, the condensation product of a $C_{14}$–$C_{15}$ alcohol with 7 moles of ethylene oxide per mole of alcohol, the condensation product of a $C_{12}$–$C_{15}$ aliphatic alcohol with from about 3 to 9 moles of ethylene oxide, and the ethylene/propylene oxide condensate marketed by Wyandotte Chemicals Corporation under the tradename of Pluradot HA 430.

The preferred self-emulsified suds suppressors, containing a modified polysiloxane having polyoxyalkylene moieties in the polymer, may be combined with any of the detersive alkoxylated surfactants well-known in the art and be formed into granular spray-dried detergent compositions. In general terms, these nonionics are water-soluble detersive surfactants of the formula $$R—O—(C_yH_{2y}O)_a—(C_zH_{2z}O)_b—C_wH_{2w}OH$$

wherein R is selected from the group consisting of primary, secondary and branched chain alkyl hydrocarbyl moieties; primary, secondary and branched chain alkenyl hydrocarbyl moieties; and primary, secondary and branched chain alkyl- and alkenyl-substituted phenolic hydrocarbyl moieties; said hydrocarbyl moieties having a hydrocarbyl chain length of from 8 to about 20, preferably 10 to 16, carbon atoms. In the general formula for the alkoxylated nonionic surfactants herein, y and z are each integers of from 2 to about 3, preferably 2, either z or y being 2 when the other integer is 3 (i.e., excluding the all—PO surfactants); w is an integer of from 2 to about 3, preferably 2, and a and b are each integers of from 0 to about 8, the sum of a + b being in the range of from 6 to about 25, preferably 6 to 10. The formula of the surfactants therein encompasses ethylene oxide (EO) as well as mixed ethylene oxide-propylene oxide (EO-PO) alkoxylates, all of which are useful herein. The all—PO surfactants do not provide cleaning advantages in detergent compositions and are not contemplated for use herein.

Preferred nonionic surfactants used herein are the ethoxylated nonionics, both from the standpoint of availability and cleaning performance.

Specific examples of alkoxylated nonionic surfactants include, but are not limited to, the di- through hexadeca-alkoxylates of $C_8$–$C_{18}$ straight chain, primary alcohols; the di- through hexadeca-alkoxylates of $C_8$–$C_{20}$ straight chain, secondary alcohols; the di-through hexadeca-alkoxylates of alkyl phenols; the di-through hexadeca-alkoxylates of primary and secondary alkenyl alcohols and alkenyl phenols; and the di-through hexadeca-alkoxylates of branched chain primary and secondary alcohols.

Particularly preferred alkoxylated nonionic surfactants include $C_8$–$C_{18}$ aliphatic alcohols condensed with 3 to about 15 moles of ethylene oxide per mole of alcohol and ($C_6$–$C_9$ alkyl) phenols condensed with from about 6 to about 16 moles of ethylene oxide per mole of phenol.

One mixed alkoxylated nonionic system which is useful herein comprises one or more of the foregoing detersive alkoxylated nonionic surfactants having an HLB in the range of from about 11 to 17 (preferably 12 to 15) and, as a "co-surfactant," one or more water-soluble alkoxylates having an HLB in the range of 7 to 10.5 (preferably 9 to 10.5). The two types of alkoxylated materials are combined in appropriate weight ratios to provide an overall HLB of the mixture of from about 10 to about 12.5 (preferably 10 to 12; most preferably 10.5 to 12.0). Such mixtures of nonionic surfactant and nonionic co-surfactant provide superior fabric cleaning performance and are particularly useful for removing greasy soil from polyester and cotton/polyester fabric blends. These preferred nonionic surfactant-plus-nonionic "co-surfactant" alkoxylate mixtures are more fully described in Belgian Pat. No. 149,552, issued Apr. 15, 1975, incorporated herein by reference.

A further highly preferred alkoxylated nonionic surfactant system is that disclosed and claimed in the commonly assigned copending U.S. patent application Ser. No. 557,217 by Jerome H. Collins, Filed Mar. 10, 1975, now abandoned and incorporated herein by reference. This surfactant system comprises a base-catalysed primary alcohol ethoxylate having the formula $R_1$—$R_2$—O $(CH_2CH_2O)_{n_{av}}H$ wherein $R_1$ is a linear alkyl residue and $R_2$ has the formula CH $R_3$ $CH_2$, $R_3$ being selected from hydrogen and mixtures thereof with $C_1$–$C_4$ alkyl groups there being not more than 70% by weight of said groups in the mixtures, wherein $R_1$ and $R_2$ together form an alkyl residue containing a mean of 9 to 15 carbon atoms at least 65% by weight of said residue having a chain length within ±1 carbon atom of the mean, wherein $3.5 < n_{av} < 6.5$. Such a system is also characterised by an unethoxylated alcohol content of <5 wt% and by at least 63 wt% of ethoxylates containing two to seven ethylene oxide groups, the HLB of the system lying in the range 9.5–11.5, The system is otherwise free of alkoxylated nonionic surfactants.

Nonionic surfactant systems of the above described type are produced by ethoxylating a suitable alcohol to less than the desired degree with a base catalyst and then stripping off the unethoxylated alcohol and lower ethoxylates to give a product having the desired ethoxylate distribution.

A preferred material of this type can be prepared from Neodol 23, a primary $C_{12}$–$C_{13}$ OXO alcohol sold by Shell Chemical Company and containing approximately 20% of 2-alkyl (predominantly methyl) branching. To make the preferred nonionic surfactant, Neodol 23 is ethoxylated with an average 3 moles of ethylene oxide per mole of alcohol and the ethoxylated material is then stripped to remove unethoxylated alcohol and lower ethoxylates. Approximately 34% by weight of the ethoxylate is removed and the residue has an HLB of about 10.55 and an ethoxylation level of about 4.9 moles per mole of alcohol.

Other Ingredients

In the broadest aspect of the present invention, the intimate mixture of the above-described two essential components can be incorporated into any of a wide variety of non-liquid detergent compositions. It will be understood that the process of incorporation must be such that the physical properties of the intimate mixture are not destroyed. In general, a sufficient amount of the intimate mixture is used to provide a concentration of from about 0.01% to about 5%, preferably 0.05% to 0.5%, by weight of the silicone suds suppressors in the composition.

The present invention encompasses detergent compositions which contain surfactant materials other than the essential nonionic surfactant. Such other surfactants are selected from anionic, nonionic, zwitterionic and ampholytic surfactants.

Examples of the above types of surfactants are listed in U.S. Pat. No. 3,862,058 of Nirschl and Gloss, the disclosure of which is incorporated herein by reference.

Useful anionic surfactants include alkyl sulfates and sulfonates containing from about 8 to about 18 carbon atoms; alkyl benzene sulfonates having from about 9 to about 20 carbon atoms in the alkyl chain, especially sodium or alkanolamine salts of linear straight chain alkyl benzene sulfonates in which the average chain length of the alkyl group is from about 10 to about 14, especially about 11.8 carbon atoms (normally abbreviated $NaC_{11.8}LAS$); alkyl ether sulfates of the formula $$R\,O\,(C_2H_4O)_n\,SO_3M$$

wherein R is alkyl or alkenyl of about 10 to about 20 carbon atoms, n is 1 to 30 and M is an alkali metal cation; and olefin sulfonates derived by the sulfonation of $C_{12}$–$C_{24}$ α-olefins with sulfur trioxide. Other useful anionic surfactants in combination with the silicone/surfactant mixture used in the present invention are alkaline earth metal, preferably magnesium or calcium, salts of linear alkyl benzene sulfonic acid. Useful nonionic surfactants, apart from those already mentioned, include amine oxides, phosphine oxides and sulfoxides. Specific examples of such surfactants include dimethyldodecylamine oxide, dimethylstearylamine oxide, bis-(2-hydroxyethyl) dodecylamine oxide, dimethyldodecylphosphine oxide, dodecylmethyl sulfoxide and octadecyl methyl sulfoxide.

Preferred zwitterionic surfactants include higher alkyl or alkaryl ammonio propane sulfonates, such as 3-(N,N-dimethyl N-hexadecylammonio) propane-1-sulfonate, 3-(N,N-dimethyl-N-hexadecylammonio)-2-hydroxy propane-2-sulfonate and 3-(N,N-dimethyl-N-alkylammonio-2-hydroxy propane-1-sulfonate, the alkyl group being derived from middle cut coconut fatty alcohol and higher alkyl or alkaryl ammoniocarboxylates such as (N-dodecylbenzyl-N,N-dimethyl ammonio) acetate, (N,N-dimethyl-N-hexadecylammonio) acetate and 6-(N-dodecylbenzyl-N,N-dimethyl ammonio) hexanoate. Other useful zwitterionic materials are the ethoxylated ammoniosulfonates and sulfates disclosed in U.S. Pat. No. 3,929,678, Laughlin et al, issued Dec. 30, 1975.

Detergent compositions of the present invention normally include builder salts, especially alkaline, polyvalent anionic builder salts. These alkaline salts serve to maintain the pH of the cleaning solution in the range from about 7 to about 12, preferably from about 8 to about 11.

When the compositions of the present invention are formed by spray-drying, such builders may be employed in the crutcher mix at concentrations of from about 10% to about 80% by weight (preferably 15% to 50%) to yield dry detergent compositions containing from about 15% to about 90% by weight, preferably from about 20% to 60%, of said builders.

Suitable detergent builder salts useful herein can be of the poly-valent inorganic or poly-valent organic types, or mixtures thereof. Non-limiting examples of suitable water-soluble, alkaline detergent builder salts include alkali metal phosphates, pyrophosphates, orthophosphates, polyphosphates, phosphonates, carbonates, polyhydroxysulfonates, silicates, polyacetates, carboxylates, polycarboxylates and succinates. Specific examples of such salts include the sodium and potassium tetraborates, perborates, bicarbonates, carbonates, tripolyphosphates, orthophosphates and hexametaphosphates.

Examples of suitable organic alkaline detergency builder salts are: (1) water-soluble amino polyacetates, e.g., sodium and potassium ethylenediamine tetraacetates, nitrilotriacetates and N-(2-hydroxyethyl) nitrilodiacetates; (2) water-soluble salts of phytic acid, e.g., sodium and potassium phytates; (3) water-soluble polyphosphonates, including, sodium, potassium and lithium salts of ethane-1-hydroxy-1,1-diphosphonic acid; sodium potassium and lithium salts of methylenediphosphonic acid and the like.

Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, incorporated herein by reference, are also suitable herein. It is to be understood that while the alkali metal salts of the foregoing inorganic and organic poly-valent anionic builder salts are preferred for use herein from an economic standpoint, the ammonium, alkanolammonium, e.g., triethanolammonium, diethanolammonium, and the like, water-soluble salts of any of the foregoing builder anions are useful herein.

A further class of detergency builder materials useful in the present invention are insoluble sodium aluminosilicates, particularly those disclosed in Belgian Pat. No. 814,874, issued Nov. 12, 1974. This patent discloses and claims detergent compositions containing sodium aluminosilicates of the formula $$Na_z(AlO_2)_z(SiO_2)_y xH_2O$$

wherein z and y are integers equal to at least 6, the molar ratio of z to y is in the range of from 1.0:1 to about 0.5:1 and x is an integer from about 15 to about 264, said aluminosilicates having a calcium ion exchange capacity of at least 200 mg. eq/gram and a calcium ion exchange rate of at least about 2 grains/gallon/minute/gram. A preferred material is $Na_{12}(SiO_2AlO_2)_{12}.27H_2O$.

Mixtures of organic and/or inorganic builders can be used herein. One such mixture of builders is disclosed in Canadian Pat. No. 755,038, e.g., a ternary mixture of sodium tripolyphosphate, trisodium nitrilotriacetate and trisodium ethane-1-hydroxy-1, 1-diphosphonate.

While any of the foregoing alkaline poly-valent builder materials are useful herein, sodium tripolyphosphate, sodium nitrilotriacetate, sodium mellitate, sodium citrate and sodium carbonate are preferred herein for this builder use. Sodium tripolyphosphate is especially preferred herein as a builder both by virtue of its detergency builder activity and its ability to suspend illite and kaolinite clay soils and retard their redeposition on the fabric surface.

In the non-spray-dried compositions of the present invention the detergent builders are generally used at concentrations of from about 10% to about 60%, preferably 20% to 50%, by weight.

Bleaching agents may also be incorporated into the compositions of the present invention and examples of typical bleaching agents are chlorinated trisodium phosphate and the sodium and potassium salts of dichloroisocyamuric acid.

The detergent compositions disclosed herein can of course contain other materials commonly used in such compositions. For example, various soil-suspending agents such as carboxymethylcellulose, corrosion inhibitors, dyes, fillers such as sodium sulfate and silica, optical brighteners, germicides, anti-tarnishing agents, pH adjusting agents such as mono-, di- or tri-ethanolamine, enzymes, and the like, well-known in the art for use in detergent compositions, can also be employed herein.

Processing of the Compositions

In a highly preferred processing aspect of the present invention, the intimate mixture of silicone suds suppressors and nonionic surfactant is formed in a liquid (if necessary molten) phase and the liquid mixture is sprayed, coated onto, adsorbed onto or absorbed into a carrier granule which contains the other ingredients of the detergent composition.

When a self-emulsified silicone material is used in conjunction with a liquid or molten liquid surfactant, then the silicone can readily be mixed into the surfactant and form a stable emulsion or dispersion. Where the less dispersible silicones are concerned, then it is necessary that the silicone/surfactant mixture (using molten surfactant) is subjected to agitation or shear shortly before being incorporated into product. In this way, the silicone material remains sufficiently dispersed in the molten surfactant that it does not migrate out before the surfactant cools and sets after being sprayed on to product. Clearly, after the surfactant has set, there is no likelihood that the silicone material can escape.

When a normally solid surfactant is used, it is usual to heat the surfactant to form a liquid phase, although the use of a solvent to bring the surfactant into solution is not excluded. In the heating process, it is important that the time during which silicone material is in contact with hot surfactant is minimized. In certain cases, silicone materials can lose their efficacy if contacted by hot, i.e. in the temperature range 120°-200° F., surfactant over relatively long periods of time, for example, over 30 minutes.

In a preferred process, therefore, liquid surfactant is sprayed continuously on to carrier granules and the silicone suds suppressor is injected into a conduit leading to the spray nozzle, mixing means being provided downstream of the point of injection. The mixing means may comprise baffles in a conduit, or a foraminous plate in the conduit which would cause the silicone material to disperse effectively throughout the surfactant.

For ease of mixing in the process, the self-emulsified silicone compounds are preferred both in admixture with solid and liquid surfactants.

Highly preferred detergent compositions of the present invention are those intended for use in automatic dishwashing machines. In these compositions, the intimate mixture of nonionic surfactant and silicone suds suppressors can be sprayed on to a base granule comprising, for example, sodium tripolyphosphate, chlorinated trisodium phosphate and sodium silicate. Such base granule can be prepared by agglomerating the sodium tripolyphosphate and the chlorinated trisodium phosphate with a solution of sodium silicate. Examples of useful processes for preparing such granules are found in U.S. Pat. Nos. 3,598,743 and 3,888,781, both incorporated herein by reference.

In the case of automatic dishwashing machine products the compositions preferably comprise from about 20% to about 60% sodium tripolyphosphate, from about 10% to about 60% sodium silicate and from about 15% to about 35% of chlorinated trisodium phosphate in the base granule. As used herein, sodium silicate means sodium silicate solids. Incorporated into this base granule is the intimate mixture of nonionic surfactant and silicone suds suppressor to give a level of surfactant in the total composition of from about 0.5% to about 50% by weight, preferably from about 1.0% to about 40% by weight, and most preferably from about 2.0% to about 30% by weight and a level of suds suppressor in the total composition from about 0.01% to about 10% by weight, preferably from about 0.02% to about 8% by weight, and most preferably from about 0.03% to about 6% by weight. Other preferred amounts of nonionic surfactant and silicone suds suppressor may be incorporated into the base granule as an intimate mixture to give a level of surfactant in the composition of from about 2.5% to about 12.5% and a level of suds suppressor of from about 0.05% to about 0.5%.

The detergent compositions of the present invention are preferably in granular form, but they can also be formulated in other non-liquid forms, for example as powders, tablets, pastes and gels.

When the particularly preferred self-emulsified silicone suds suppressors containing a modified polysiloxane having polyoxyalkylene in the polymer are used, the process herein may be carried out by preparing a detergent crutcher mix comprising the various components which are to be present in the final detergent composition in an aqueous medium.

The crutcher mixes employed in this process can conveniently comprise an aqueous slurry containing from about 15% to about 50% (preferably from about 25% to about 40%) by weight of water, from about 1% to about 40% (preferably from about 5% to about 20%) by weight of a water-soluble organic detergent component comprising predominantly a nonionic surfactant as hereinbefore described, and from about 10% to about 80% (preferably from about 15% to about 50%) by weight of detergency builder and adjunct materials as hereinbefore disclosed.

Use of the foregoing crutcher mixes in combination with an amount of from about 0.005% to about 5% by weight of the crutcher mix of the preferred self-emulsified suds suppressors results in the formation of substantially homogeneous mixes suitable for preparing homogeneous powdered and granular detergent compositions. Of course, such detergent compositions contain the various ingredients originally present in the crutcher mix. However, the final concentrations of such ingredients in the dry detergent compositions may differ somewhat from their concentrations in the crutcher, inasmuch as a major portion of the water is removed on drying.

The preferred self-emulsified silicone suds suppressor, although generally stable in the presence of nonionic surfactant, can become inactivated if subjected to extremes of heat in the presence of surfactant. It is therefore preferred that the crutcher mix is formed and blended as quickly as possible and then spray-dried without undue delay. Generally, residence time in the crutcher of the silicone-containing mix should not exceed about 10–15 minutes.

It is preferred that the silicone suds suppressor is intimately mixed with the nonionic surfactant before being added to the crutcher, as it is believed to be important that the silicone material remains in the same phase as the nonionic surfactant.

The crutcher mix is generally prepared at a temperature of 140° F. to 150° F. and the hot mix is introduced into a spray-drying tower and sprayed to provide a granular detergent composition. The spray-drying part of the process is conventional.

The following examples are representative of the compositions and processes of the present invention.

EXAMPLE I

A detergent composition for an automatic dishwashing machine was prepared having the following ingredients:

| Component | % by Wt. of the Composition |
|---|---|
| Sodium tripolyphosphate (STP) | 43.0 |
| Sodium silicate ($SiO_2$:$Na_2O$ ratio 2.8) | 16.0 |
| Chlorinated trisodium phosphate (C TSP) | 26.0 |
| Tallow alcohol condensed with 9 moles of ethylene oxide per mole of alcohol ($TAE_9$) | 7.5 |
| [1]Dow Corning DB 544 suds suppressor | 0.4 |
| Moisture and minors | to 100 |

[1]A silicone suds suppressor containing a siloxane/glycol copolymer.

To prepare the above composition, the STP and the Cl TSP were mixed and agglomerated in a pan granulator using a solution of the sodium silicate. After granulation was complete, the $TAE_9$ was heated to above its melting point and the DB 544 suds suppressor was mixed into the $TAE_9$ to form a stable emulsion. The molten emulsion was then sprayed onto the granular material to form the detergent composition.

The above composition was tested in the following manner:

Production of foam in an automatic dishwashing machine causes a reduction in the speed of revolution of the rotor arm which is activated by the force of water or detergent solution passing through the arm. Using the speed of the rotor arm with pure water as a control (100% efficiency). The speed of the rotor in a soiled surfactant solution is measured. In general, when a low-sudsing surfactant is used together with a suds suppressor, the rotor arm revolves at around 90% of its speed in water. The figure of 90% is termed the "suds efficiency." The higher the figure, the more effective is the suds suppressor.

The composition of Example I, freshly made, had a suds efficiency of 90%. After nine weeks storage at 90° F., the composition was tested again and was found still to have a suds efficiency of 90%.

Substantially similar results are obtained where the DB544, in the above composition, is replaced by DB31, a silicone/silica suds suppressor containing a high ethoxylate fatty acid emulsifying component, marketed by Dow Corning.

EXAMPLE II

A composition analogous to that of Example I but containing 0.3% of polydimethylsiloxane in place of the DB 544 suppressor was prepared. No substantial change in suds efficiency of the composition was noted after 3 weeks.

EXAMPLE III

A composition analogous to that of Example I but containing 0.4% of Dow Corning DB 100 suds suppressor (a silicone/silica suppressor) in place of the DB 544 suppressor was prepared.

EXAMPLE IV

Using the procedure of Example I, the following composition was prepared:

| Component | % by Wt. |
|---|---|
| Sodium tripolyphosphate | 26.0 |
| Sodium silicate ($SiO_2$:$Na_2O$ ratio 2.4) | 5.0 |
| Sodium silicate ($SiO_2$:$Na_20$ ratio 2.8) | 12.0 |
| Chlorinated trisodium phosphate | 22.0 |
| $TAE_9$ | 5.0 |
| [1]SAG 100 | 0.2 |
| Moisture and minors | to 100 |

[1]A polydimethylsiloxane marketed by Union Carbide.

Using the suds test detailed above, the above composition was tested before and after 3 weeks storage at 90° F. No significant change in suds efficiency was observed.

EXAMPLE V

A detergent composition suitable for use in an automatic dishwashing machine and having a normally liquid nonionic surfactant was prepared in a manner analogous to that described in Example I and having the following composition:

| Component | % by Wt. |
|---|---|
| STP | 46.0 |
| Sodium silicate ($SiO_2$:$Na_2O$ ratio 2.8) | 17.0 |

-continued

| Component | % by Wt. |
|---|---|
| Cl TSP | 26.0 |
| Coconut fatty alcohol condensed with 6 moles of ethylene oxide per mole of alcohol | 7.5 |
| DB 544 | 0.4 |
| Moisture and minors | to 100 |

This composition was relatively high-sudsing and, freshly made, had a suds efficiency of 57%. After 3 weeks storage at 90° F., the suds efficiency was measured and was found to be 54% which is not significantly reduced.

Substantially similar results were obtained where the DB544 in the above composition was replaced by DB31, a silicone/silica suds suppressor containing a high ethoxylate (containing from about 300 to 2000 ethoxy groups per molecule) fatty acid emulsifying component, marketed by Dow Corning.

Comparable results are also obtained where the DB544 in the above composition is replaced by DB100 suds suppressor together with a zwitterionic surfactant as an emulsifying component, such as

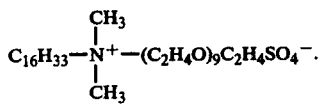

$$C_{16}H_{33}-\overset{\overset{CH_3}{|}}{\underset{\underset{CH_3}{|}}{N^+}}-(C_2H_4O)_9C_2H_4SO_4^-.$$

EXAMPLE VI

A composition similar to that of Example V was prepared, but using Pluradot HA 430 (Wyandotte Chemical Corporation) as the sole nonionic surfactant (a liquid surfactant). In this case, only 0.1% of DB544 was employed and the composition was found to be storage-stable and to have good suds suppression.

All of the above examples provided compositions with good storage stability as evidenced by the continued activity of the suds suppressor after from three to 9 weeks of storage at 90° F.

A composition comprising a carrier granule based on sodium carbonate and sodium silicate and using the liquid nonionic surfactant of Example V together with polydimethylsiloxane suds suppressor was found to have a suds efficiency of 89% when freshly made, but this dropped rapidly to 80% after 2 weeks and continued to fall thereafter.

EXAMPLE VII

A spray-dried detergent composition was prepared, using the preferred self-emulsifying suds suppressors of the present invention and having the following composition:

| Component | % by Wt. of the Composition |
|---|---|
| [1]Neodol 23 ethoxylated with 3 moles of ethylene oxide and stripped to HLB 10.55 | 11.0 |
| Sodium tripolyphosphate | 32.0 |
| Sodium silicate (1.6 ratio $Na_2O:SiO_2$) | 10.0 |
| [2]DB 544 | 0.2 |
| Sodium sulfate | 38.0 |
| Moisture and minors | to 100 |

[1]Neodol 23 is obtainable from Shell Chemical Company

[2]From Dow Corning, a silicone suds suppressor containing a copolymer of polydimethylsiloxane and a polyalkylene oxide.

To prepare the above composition, all the ingredients of the composition were slurried in water and blended at 150° F. to give a homogeneous crutcher mix. The mix was then introduced into a spray-drying tower and spray-dried to form homogeneous granules.

The resultant composition exhibited controlled sudsing characteristics which were maintained after storage at 90° F. and 80% relative humidity for 3 weeks.

The same composition as above but with Dow Corning DB 100 suds suppressor replacing DB 544 showed no suds suppression after spray-drying, even when fresh. DB 100 does not contain a polyoxyalkylene-modified polysiloxane emulsifying component.

EXAMPLE VIII

A granular heavy-duty detergent composition was prepared by spray-drying in a conventional manner a detergent slurry. The slurry has the following composition:

| Ingredient | Parts by Wt. |
|---|---|
| Condensate of $C_{14}$-$C_{15}$ 1:1 blend alcohol with 7 moles of ethylene oxide | 17.0 |
| 4,4'thiobis (6-tert-butyl-m-cresol) | 0.02 |
| Berol 525 | 0.7 |
| Pentasodium tripolyphosphate anhydrous | 46.0 |
| Saturated $C_{16}$-$C_{22}$ fatty acid | 0.7 |
| Silicate solids, ratio $SiO_2$: NaO 2.0 | 8.0 |
| Sodium sulfate | 14.0 |
| Minor ingredients | 3.0 |
| Water | 40.0 |
| Suds regulating agent (Dow Corning DB 544) | 0.3 |

Substantially similar compositions were prepared (a) without the addition of the DB 544 suds regulator, and (b) replacing the DB 544 regulator by an identical amount of the suds regulator described in Belgian Pat. No. 803,101 of Feb. 1, 1974 to Bartolotta et al.

Seventy-five parts by weight of the granular base powder obtained after spray-drying the above slurry were dry-mixed with 25 parts by weight granular perborate tetrahydrate and 1% of additional minor ingredients inclusive of a proteolytic enzyme, a perfume and a polyethylene glycol having a molecular weight of about 400.

The suds regulating capacity of the granular bleach-containing finished product so formulated was tested (1) freshly made; and (2) after an accelerated storage test as more fully defined hereinafter. The suds regulating capacity was measured with a front-loading Miele drum washing machine under the following conditions.

Cloth load: 4 kg

Product concentration: 0.65% (weight/volume)

Temperature cycle: mainwash up to the boil

The suds height, expressed in centimeters, was measured at a temperature of 90° C. through the front window. The results were as follows:

| | No Suds Suppressor | Suds Suppressor of Belgian Patent 803,101 Incorporated by Crutching | Drymixing | DB 544 Suds Regulator (Incorporated by Crutching) |
|---|---|---|---|---|
| Freshly made | 12 | 6 | 4 | 5 |
| Storage: 1 week 35° C; 80% R.H. | — | 10 | 4 | 5 |
| Storage: 1 week 50° C | — | 12 | 8 | 6 |

In the above scale, 6 cm. represents a consumer acceptable suds level at up to the boil conditions (90° C.). Suds levels of 8 cm. and above are undesirable. Thus compositions according to this invention are at least as good as or better than identical compositions wherein the suds regulator has been replaced with an equivalent amount of a suds suppressor which is known to be suitable for commercial purposes.

EXAMPLE IX

An automatic dishwashing composition which contains enzymes was prepared according to the procedure outlined in Example I. The composition produced was as follows:

| Ingredient | Wt. % |
|---|---|
| Condensation product of one mole of tallow alcohol with nine moles of ethylene alcohol ($TAE_9$) | 15.8 |
| Dow Corning DB-544 suds suppressor[1] | 3.06 |
| Sodium silicate solids ($SiO_2$:$Na_2O$ ratio 3.2) | 4.4 |
| Sodium carbonate | 27.3 |
| Sodium tripolyphosphate | 20.5 |
| SP-72[2] | 0.6 |
| Termamyl[3] | 0.6 |
| Sodium sulfate | 20.0 |
| Moisture and minors | balance to 100 |

[1]A silicone suds suppressor containing a siloxane glycol copolymer
[2]Proteolytic enzyme available from Novo Industries A/S, Copenhagen, Denmark. 3.0 Anson units/gram (8.0 Kilo Novo Protease Units/g) of enzyme preparation. Exhibits an activity of greater than 80% of its maximum activity when measured at pH 12 using the Anson hemoglobin method in the presence of urea.
[3]Amylolytic enzyme available from Novo Industries A/S, Copenhagen, Denmark. Available in solution or granular form, with activity of 66.2 Kilo Nova Units/g. Exhibits an amylolytic activity of greater than 50% of its maximum activity when measured at pH 8 by the SKB method at 37° C.

This particular composition, which combines a solid nonionic surfactant with a self-emulsified silicone suds suppressor, exhibits excellent cleaning of cookware and glassware, leaving no spots or films.

Substantially similar results are obtained where DB-544 is replaced by DB-31, a silicone/silica suds suppressor which contains a high ethoxylate fatty acid emulsifying component, and is marketed by Dow Corning. Substantially similar results are also obtained when DB-544 is substituted with DB-100, a silicone/silica suds suppressor also manufactured by Dow Corning. DB-544 may be substituted with DB-100 which contains a switterionic surfactant as an emulsifying component, such as

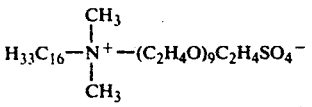

with substantially similar results. DB-544 may also be substituted with an identical amount of the suds regulator described in Belgian Pat. No. 803,101 of Feb. 1, 1974 to Bartolotta et al., the condensation product of about 500 moles of ethylene oxide with one mole of stearic acid, or an identical amount of polydimethylsiloxane, with substantially similar results.

Substantially similar results are also obtained when $TAE_9$ is substituted with coconut fatty alcohol condensed with about 6 moles of ethylene oxide per mole of alcohol, Neodol 23 (a liquid $C_{12-13}$ linear primary alcohol) ethoxylated with about 3 moles of ethylene oxide and stripped to HLB about 10.55 (available from the Shell Chemical Company), the condensate of $C_{14-15}$ 1:1 blend alcohol with about 7 moles of ethylene oxide, Pluradot HA-430 (a liquid tri-functional polyoxyalkylene glycol available from the Wyandotte Chemical Corporation), Igepal CO-610 (a liquid nonylphenoxypoly(ethyleneoxy)ethanol, marketed by the GAF Corporation), Pluronic 25R5, 10R8, 17R8, 25R8, and 31R4 (solid condensates of propylene oxide with hydrophilic bases formed by condensing ethylene oxide with ethylene glycol available from BASF Wyandotte), Tetronic 707 and 908 (solid compounds formed by the addition of propylene oxide to ethylene diamine, followed by the addition of ethylene oxide, commercially available from BASF Wyandotte), Tetronic 304, 504, 701, 702, 704, 901, 1101, 1102, 1301, 1302, 1501, and 1502 (liquid compounds formed by the addition of ethylene oxide commercially available from BASF Wyandotte), Triton X-45, X-100, X-102, and X-114 (liquid octylphenoxy polyethoxy ethanols, commercially available from Rohm & Haas Co.) the condensation product of about 9.5 moles of ethylene oxide and one mole of nonyl alcohol, Pluronic 10R5, 17R1, 17R2, 17R4, 25R1, 25R2, 25R4, 31R1, and 31R2 (liquid condensates of propylene oxide with hydrophilic bases formed by condensing ethylene oxide with ethylene glycol available from BASF Wyandotte), and mixtures thereof.

EXAMPLE X

A bleach-containing automatic dishwashing composition, which combines a liquid surfactant with a self-emulsifiable silicone suds suppressor, was prepared according to the procedure outlined in Example I. The composition produced was as follows:

| Component | Wt. % |
|---|---|
| Sodium tripolyphosphate (STP) | 20.5 |
| Sodium silicate solids ($SiO_2$:$Na_2O$ ratio 3.2) | 4.4 |
| Sodium carbonate | 14.0 |
| Chlorinated trisodium phosphate (Cl TSP) | 22.0 |
| Coconut fatty alcohol condensed with about six moles of ethylene oxide per mole of alcohol | 25.0 |
| DB-544[1] | 5.0 |
| Moisture and minors | balance to 100 |

[1]A silicone suds suppressor containing a siloxane glycol colpolymer commercially available from Dow Corning.

Substantially similar results are obtained where DB-544 is replaced by DB-31, a silicone/suds suppressor which contains a high ethoxylate fatty acid emulsifying component, and is marketed by Dow Corning. Substantially similar results are also obtained when DB-544 is substituted with DB-100, a silicone/silica suds suppressor also manufactured by Dow Corning. DB-544 may be substituted with DB-100 which contains a zwitterionic surfactant as an emulsifying component, such as

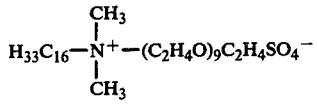

with substantially similar results. DB-544 may also be substituted with an identical amount of the suds regulator described in Belgian Pat. No. 803,101 of Feb. 1, 1974 to Bartolotta, et al., the condensation product of about 500 moles of ethylene oxide with one mole of stearic acid, or an identical amount of polydimethylsiloxane, with substantially similar results.

Substantially similar results are also obtained when $TAE_9$ is substituted with coconut fatty alcohol condensed with about 6 moles of ethylene oxide per mole of alcohol, with Neodol 23 (a liquid $C_{12-13}$ linear primary alcohol) ethoxylated with about 3 moles of ethylene oxide and stripped to HLB about 10.55 (available from the Shell Chemical Company), with the condensate of $C_{14-15}$ 1:1 blend alcohol with about 7 moles of ethylene oxide, Pluradot HA-430 (a liquid trifunctional polyoxyalkylene glycol available from the Wyandotte Chemical Corporation), Igepal CO-610 (a liquid nonylphenoxypoly(ethyleneoxy)ethanol, marketed by the GAF Corporation), Pluronic 25R5, 10R8, 17R8, 25R8, and 31R4 (solid condensates of propylene oxide with hydrophilic bases formed by condensing ethylene oxide with ethylene glycol, available from BASF Wyandotte), Tetronic 707 and 908 (solid compounds formed by the addition of propylene oxide to ethylene diamine, followed by the addition of ethylene oxide, commercially available from BASF Wyandotte), Tetronic 304, 504, 701, 702, 704, 901, 1101, 1102, 1301, 1302, 1501, and 1502 (liquid compounds formed by the addition of propylene oxide to ethylene diamine, followed by the addition of ethylene oxide, commercially available from BASF Wyandotte), Triton X-45, X-100, X-102, and X-114 (liquid octylphenoxy polyethoxy ethanols, commercially available from Rohm & Haas Co.), the condensation product of about 9.5 moles of ethylene oxide and one mole of nonyl alcohol, Pluronic 10R5, 17R1, 17R2, 17R4, 25R1, 25R2, 25R4, 31R1, and 31R2 (liquid condensates of propylene oxide with hydrophilic bases formed by condensing ethylene oxide with ethylene glycol, commercially available from BASF Wyandotte).

EXAMPLE XI

A bleach-containing automatic dishwashing composition, which combines a normally solid nonionic surfactant and a non-self-emulsified silicone suds suppressor, was prepared according to the procedure outlined in Example I. The composition produced was as follows:

| Component | Wt. % |
|---|---|
| Sodium tripolyphosphate (STP) | 20.5 |
| Sodium silicate solids ($SiO_2$:$Na_2O$ ratio 3.2) | 4.4 |
| Sodium carbonate | 14.0 |
| Chlorinated trisodium phosphate (Cl TSP) | 22.0 |
| Tallow alcohol condensed with about 9 moles of ethylene oxide per mole of alcohol ($TAE_9$) | 25.0 |
| SAG-100[1] | 5.0 |
| Moisture and minors | balance to 100 |

[1]A polydimethylsiloxane marketed by Union Carbide.

Substantially similar results are obtained when SAG-100 is substituted with diethyl polysiloxanes, a mixture of an alkylated siloxane and silica a silicone:silica ratio from about 19:1 to about 1:3, a mixture of fumed silica with trimethylchlorosilane and hydrophobic silanated silica, a mixture of silica and sodium stearate, a mixture of silica and ethyltrichlorosilane, a mixture of hydrophobic trimethylsilanated silica and dimethyl silicone fluid of molecular weight from about 500 to about 200,000 with a silicone:silanated weight ratio from about 10:1 to about 1:1, silicone resins prepared from the hydroylsis of dichlorosilanes, and mixtures thereof.

Substantially similar results are also obtained when $TAE_9$ is substituted with the condensation product of about one mole of nonyl phenol with about 9.5 moles of ethylene oxide, the condensation product of about one mole of a $C_{15-20}$ aliphatic alcohol with from about 6 moles to about 20 moles of ethylene oxide, the ethylene oxide/propylene oxide copolymer marketed under the designation of Pluronic 25R5, 10R8, 17R8, 25R8, and 31R4 (solid condensates of propylene oxide with hydrophilic bases formed by condensing ethylene oxide with ethylene glycol, available from BASF Wyandotte), Tetronic 707 and 908 (solid compounds formed by the addition of ethylene oxide, commercially available from BASF Wyandotte), and mixtures thereof.

What is claimed is:

1. A detergent composition comprising (A) from about 10 to about 60% of a detergent builder salt, and (B) an intimate mixture consisting essentially of (i) from about 0.5% to about 50% by weight of the composition of a normally solid nonionic surfactant selected from the group consisting of (a) the condensation product of alkyl phenols with from about 5 to 20 moles of ethylene oxide;

(b) the condensation product of $C_8$–$C_{22}$ aliphatic alcohols with from about 3 to 20 moles of ethylene oxide;

(c) the condensation product of ethylene oxide with a hydrophobic base formed by the condensation of propylene oxide with propylene glycol, wherein the molecular weight of the hydrophobic portion is from about 1,500 to about 1,800;

(d) the condensation product of ethylene oxide with the product resulting from the reaction of propylene oxide and ethylene diamine, wherein the molecular weight of the hydrophobic portion is from about 2,500 to about 3,000 and the condensation product contains from about 40 to about 80% by weight of polyoxyethylene; and (e) mixtures thereof, and (ii) from about 0.01% to about 10% by weight of the composition of a non-self-emulsified silicone suds suppressor.

2. The composition of claim 1 which contains from about 1.0% to about 40% by weight of a normally solid nonionic surfactant (B)(i).

3. The composition of claim 2 which contains from about 2.0% to about 30% by weight of a normally solid nonionic surfactant (B)(i).

4. The composition of claim 2 which contains from about 0.01% to about 10% by weight of a non-self-emulsified silicone suds suppressor (B)(ii).

5. The composition of claim 4 which contains from about 0.02% to about 8% by weight of a non-self-emulsified silicone suds suppressor (B)(ii).

6. The composition of claim 5 which contains from about 0.03% to about 6% by weight of a non-self-emulsified silicone suds suppressor (B)(ii).

7. A detergent composition according to claim 5 wherein the suds suppressor is a polydimethylsiloxane fluid.

8. A detergent composition according to claim 5 wherein the nonionic surfactant is a $C_{15}$–$C_{20}$ aliphatic alcohol condensed with from 6 to about 20 moles of ethylene oxide per mole of alcohol.

9. A detergent composition according to claim 5 wherein the suds suppressor is a mixture of a polydimethylsiloxane fluid and silica.

10. A detergent composition according to claim 5 wherein the suds suppressor is a mixture which comprises:

(a) from about 10 parts to about 100 parts by weight of a polydimethylsiloxane fluid having a viscosity in the range from 20 cs. to 1500 cs. at 25° C.;

(b) from 5 to 50 parts by weight of a siloxane resin composed of $(CH_3)_3SiO_{1/2}$ units and $SiO_2$ units in which the ratio of the $(CH_3)_3SiO_{1/2}$ units to the $SiO_2$ units is within the range of from 0.6/1 to 1.2/1; and (c) from 1 to 10 parts by weight of a silica aerogel.

11. A detergent composition comprising (A) from about 10% to about 60% by weight of a detergent builder salt, and (B) an intimate mixture consisting essentially of (i) from about 0.5% to about 50% by weight of the composition of a nonionic surfactant, and (ii) from about 0.01% to about 10% by weight of the composition of a self-emulsified silicone suds suppressor containing a silicone suds suppressor and an emulsifier therefor selected from the group consisting of (a) a modified polysiloxane having at least one polyoxyalkylene moiety in the polymer;

(b) a high ethoxylate of a fatty acid;

(c) zwitterionic surfactants; and (d) mixtures thereof.

12. The composition of claim 11 wherein the emulsifier is the condensation product of from about 300 to about 2,000 moles of ethylene oxide per mole of fatty acid.

13. The composition of claim 11 which contains from about 1.0% to about 40% by weight of a nonionic surfactant (B)(i).

14. The composition of claim 13 which contains from about 2.0% to about 30% by weight of a nonionic surfactant (B)(i).

15. The composition of claim 14 which contains from about 0.01% to about 10% by weight of a self-emulsified silicone and suppressor (B)(ii).

16. The composition of claim 15 which contains from about 0.02% to about 8% by weight of a self-emulsified silicone suds suppressor (B)(ii).

17. The composition of claim 16 which contains from about 0.03% to about 6% by weight of a self-emulsified silicone suds suppressor.

18. The composition of claim 17 wherein said nonionic surfactant is selected from the group consisting of (a) the condensation product of alkyl phenols with from about 5 to 20 moles of ethylene oxide;

(b) the condensation product of $C_8$–$C_{22}$ aliphatic alcohols with from about 3 to 18 moles of ethylene oxide;

(c) the condensation product of ethylene oxide with a hydrophobic base formed by the condensation of propylene oxide with propylene glycol, wherein the molecular weight of the hydrophobic portion is from about 1,500 to about 1,800;

(d) the condensation product of ethylene oxide with the product resulting from the reaction of propylene oxide and ethylene diamine, wherein the molecular weight of the hydrophobic portion is from about 2,500 to about 3,000 and the condensation product contains from about 40 to about 80% by weight of polyoxyethylene; and (e) mixtures thereof.

19. A detergent composition according to claim 18 wherein the nonionic surfactant is normally liquid.

20. A detergent composition according to claim 19 wherein the self-emulsified silicone suds suppressor contains the condensation product of from about 300 to 2000 moles of ethylene oxide with a fatty acid.

21. A detergent composition according to claim 18 wherein the self-emulsified silicone suds suppressor contains, as an emulsifier, a modified polysiloxane having at least one polyoxyalkylene moiety in the polymer.

22. A detergent composition according to claim 18 wherein the self-emulsified silicone component contains an emulsifier having the general formula $R_aSiY_{4-a}$, wherein $a$ is 0 or an integer from 1 to 3; R is selected from the group consisting of (a) alkyl groups containing from 1 to about 30 carbon atoms, and (b) groups having the formula $—R'—(OR')_bOR''$, wherein R' is an alkylene group containing from 1 to about 6, preferably from 2 to 4 carbon atoms, $b$ has a value of from 1 to about 100; and R'' is a capping group which can be selected from the group consisting of hydrogen, alkyl, aryl, alkaryl, aralkyl or alkenyl groups containing up to 20 carbon atoms, sulfate, sulfonate, phosphate, phosphonate, borate or isocyanate groups, or mixtures thereof; and Y is a group having the formula $$(-O-\underset{\underset{R}{|}}{\overset{\overset{R}{|}}{Si}}-)_c-OSiR_3$$

wherein R has the formula given hereinbefore, and c has a value from 1 to 200; and wherein at least one R group in the compound has the formula $[—R'(OR')_b—R'']$, in which $b$ is sufficiently large to create an emulsifier.

23. A detergent composition according to claim 22 wherein the suds suppressor additionally comprises a polydimethylsiloxane fluid.

24. A detergent composition according to claim 22 wherein the suds suppressor consists essentially of at least 50% by weight of a compound of the formula $R_aSiY_{4-a}$, from about 5% to about 45% of a polydimethylsiloxane liquid and from 0.05 to about 5% of silica.

25. A detergent composition according to claim 24 wherein the nonionic surfactant is a $C_{12}$–$C_{15}$ aliphatic alcohol condensed with from 3 to about 9 moles of ethylene oxide per mole of alcohol.

26. A spray-dried granular detergent composition comprising (a) from about 2 to about 60% of an alkoxylated nonionic surfactant, and (b) a suds suppressing amount of a self-emulsified silicone suds suppressor containing a modified polysiloxane having polyoxyalkylene moieties in the polymer.

27. A detergent composition according to claim 26 wherein the silicone suds suppressor is present in an amount of from about 0.01 to about 5% by weight of the composition.

28. A detergent composition according to claim 25 wherein the nonionic surfactant is present in an amount of from about 5 to about 35% by weight of the composition.

29. A detergent composition according to claim 28 additionally comprising from about 10 to about 80% of a detergency builder.

30. A detergent composition according to claim 29 wherein the self-emulsified silicone component contains an emulsifier having the general formula $R_aSiY_{4-a}$ wherein $a$ is 0 or an integer from 1 to 3; R is selected from the group consisting of (a) alkyl group containing from 1 to about 30 carbon atoms, and (b) groups having the formula $—R'—(OR')_bOR''$ wherein R' is an alkylene group containing from 1 to about 6, preferably from 2 to 4 carbon atoms, $b$ has a value of from 1 to about 100; and R'' is a capping group which can be selected from the group consisting of hydrogen, alkyl, aryl, alkaryl, aralkyl or alkenyl groups containing up to 20 carbon atoms; acyl groups containing up to 20 carbon atoms, sulfate, sulfonate, phosphate, phosphonate, borate or isocyanate groups, or mixtures thereof; and Y is a group having the formula $$(-O-\underset{\underset{R}{|}}{\overset{\overset{R}{|}}{Si}}-)_c-OSiR_3$$

wherein R has the formula given hereinbefore, and $c$ has a value from 1 to 200; and wherein at least one R group in the compound has the formula $[—R'(OR')_b—R'']$ in which $b$ is sufficiently large to create an emulsifier.

31. A detergent composition according to claim 30 wherein the suds suppressor additionally comprises a polydimethylsiloxane fluid.

32. A detergent composition according to claim 31 wherein the suds suppressor consist essentially of at least 50% by weight of a compound of the formula $R_aSiY_{4-a}$, from about 5 to about 45% of a polydimethylsiloxane liquid and from 0.5 to about 5% of silica.

33. A detergent composition according to claim 32 wherein the nonionic surfactant is selected from the group consisting of $C_8$–$C_{18}$ aliphatic alcohols condensed with from 3 to about 15 moles of ethylene oxide per mole of alcohol and ($C_6$–$C_9$ alkyl) phenols condensed with from about 6 to about 16 moles of ethylene oxide per mole of phenol.

34. A detergent composition according to claim 33 wherein the nonionic surfactant is prepared by ethoxylating a $C_{12}$–$C_{13}$ alcohol containing approximately 20% of 2-alkyl, predominantly methyl, branching, with 3 moles of ethylene oxide per mole of alcohol and stripping the ethoxylated material to remove low-molecular weight components to yield an ethoxylated alcohol with an average of about 4.9 moles of ethylene oxide per mole of alcohol and an HLB of about 10.55.

35. A detergent composition according to claim 34 wherein the detergency builder is selected from the group consisting of water-soluble alkali metal, pyrophosphates, orthophosphates, polyphosphates, phosphonates, carbonates, polyhydroxysulfonates, silicates, polyacetates, and succinates.

36. A process for preparing a detergent composition according to claim 26 comprising the steps of (a) forming a homogeneous, aqueous slurry comprising (i) from about 1 to about 40% by weight of the slurry of an alkoxylated nonionic surfactant, (ii) from about 0.005 to about 4% by weight of the slurry of a self-emulsified silicone suds suppressor having a modified polysiloxane having polyoxyalkylene moieties in the polymer, and (iii) from about 15 to about 50% by weight of the slurry of water; and (b) drying the homogeneous slurry to form a granular detergent composition.

37. A process according to claim 36 wherein the drying step is performed by spray-drying the slurry.

38. A process according to claim 37 wherein the aqueous slurry additionally comprises from about 10 to about 80% of a detergency builder.

* * * * *